US012789326B2

(12) United States Patent
Dunne et al.

(10) Patent No.: US 12,789,326 B2
(45) Date of Patent: Nov. 10, 2026

(54) IMPREGNATED DIAMOND CUTTER WITH AN IMPROVED ROP

(71) Applicants: CNPC USA CORP., Houston, TX (US); BEIJING HUAMEI INC., Beijing (CN); CHINA NATIONAL PETROLEUM CORPORATION, Beijing (CN)

(72) Inventors: Timothy Dunne, Pearland, TX (US); Chris Cheng, Houston, TX (US); Qi Peng, Beijing (CN); Jiaxiang Ren, Houston, TX (US)

(73) Assignees: CNPC USA CORPORATION, Houston, TX (US); BEIJING HUAMEI INC., Beijing (CN); CHINA NATIONAL PETROLEUM CORPORATION, Beijing (CN)

( * ) Notice: Subject to any disclaimer, the term of this patent is extended or adjusted under 35 U.S.C. 154(b) by 473 days.

(21) Appl. No.: 18/342,554

(22) Filed: Jun. 27, 2023

(65) Prior Publication Data

US 2025/0001553 A1 Jan. 2, 2025

(51) Int. Cl.
*B24D 18/00* (2006.01)
*B24D 3/10* (2006.01)

(52) U.S. Cl.
CPC ..... *B24D 18/0027* (2013.01); *B24D 3/10* (2013.01); *B24D 18/0009* (2013.01)

(58) Field of Classification Search
CPC . C22C 26/00; C22C 1/05; C22C 29/08; B22F 2005/001; B22F 2007/066; B24D 18/0009; B24D 3/06; B24D 18/00; B24D 18/0027; B24D 3/00; B24D 3/10; C09K 3/1436; C09K 3/1409; Y10T 408/81
USPC ..... 51/307, 295; 175/434
See application file for complete search history.

(56) References Cited

U.S. PATENT DOCUMENTS

| | | | | |
|---|---|---|---|---|
| 8,789,627 | B1 | 7/2014 | Sani et al. | |
| 9,267,332 | B2 | 2/2016 | Rupp et al. | |
| 10,041,304 | B2 * | 8/2018 | Saini | E21B 10/5735 |
| 2012/0325049 | A1 | 12/2012 | Levashov et al. | |
| 2013/0167447 | A1 | 7/2013 | Webb et al. | |
| 2018/0245405 | A1 * | 8/2018 | Konovalov | B22F 3/14 |

FOREIGN PATENT DOCUMENTS

| | | | | |
|---|---|---|---|---|
| RU | 2650459 C1 * | 4/2018 | | B24D 18/00 |

OTHER PUBLICATIONS

Konstanty, "Production parameters and materials selection of powder metallurgy diamond tools" Powder Metallurgy, 2006, 49(4), pp. 299-306 (Year: 2006).*
Machine translation of RU 2650459 C1 (Year: 2018).*
(Continued)

*Primary Examiner* — Amber R Orlando
*Assistant Examiner* — Ryan Patrick Loughran
(74) *Attorney, Agent, or Firm* — Frank Gao, Esq.

(57) ABSTRACT

An impregnated diamond cutter and a method of making the impregnated diamond cutter are disclosed. An impregnated diamond cutter may comprise a superabrasive volume. The superabrasive volume may have a plurality of diamond particles and a metal binder. The metal binder may comprise CoCuFeP.

13 Claims, 11 Drawing Sheets

(56) References Cited

OTHER PUBLICATIONS

Xu et al., "Development of a Diamond Containing Material for Drilling in Ultrahard Formations" Contributed Papers from Materials Science and Technology 2019, pp. 99-106 (Year: 2019).*
The International search report and written opinion received on Mar. 19, 2024; Appln No. PCT/US2023/069194.
Borowiecka-Jamrozek et al. Modelling of retention of a diamond particle in matrices based on Fe and Cu, Procedia Engineering, 2017, vol. 177, pp. 289-296.

* cited by examiner

| Parameter | Setpoint |
|---|---|
| Wheel RPM | 100 |
| Abrasive | 30 mesh alumina |
| Test Duration | 1000 revolutions |
| Normal Force | 20 kg (44 pounds) |

IMPREGNATED DIAMOND CUTTER WITH AN IMPROVED ROP

TECHNICAL FIELD AND INDUSTRIAL APPLICABILITY

The present invention relates generally to superabrasive materials and a method of making superabrasive materials, and more particularly, to impregnated diamond cutter with an improve rate of penetration (ROP).

BACKGROUND OF THE INVENTION

Ultrahard diamond composite materials, typically in the form of abrasive compacts, are used extensively in cutting, milling, grinding, drilling and other abrasive operations, and also may be used as bearing surfaces and the like.

They generally contain a diamond phase, typically diamond particles, dispersed in a second phase matrix or binder phase. The matrix may be metallic or ceramic or a cermet. These particles may be bonded to each other by the binder during the high pressure and high temperature compact manufacturing process generally used, forming impregnated diamond cutters.

A known process issue encountered during HPHT synthesis which could not be optimized is the uneven distribution of diamond grains inside the diamond layer after HPHT sintering. This is because that the diamond feeds employed have multiple sizes ranging from nanometers to a few tens micrometers that caused inhomogeneous distribution during feed blending process, resulting in segregation of the diamond feeds. This would cause inconsistent cutting performance if existing in the PDC layer, leading to a premature failure during performance testing.

Therefore, there is a need to have impregnated diamond cutters to improve overall mechanical properties including wear resistance and toughness by modifying their constitutions.

SUMMARY

In one embodiment, an impregnated diamond cutter may comprise a superabrasive volume has a plurality of diamond particles and a metal binder, wherein the metal binder comprises CoCuFeP.

In another embodiment, a method of making an impregnated diamond cutter may comprise steps of mixing a metal binder with a plurality of diamond particles in liquid such as isopropanol, to form a paste; extruding the paste into sausages that are rolled and dried into irregular granules; subjecting the irregular granules to a mold cavity which is under a first condition of temperature and pressure to form a green product; and subjecting the green product to a second condition of temperature and pressure suitable to produce the impregnated diamond cutter.

In yet another embodiment, a method of making an impregnated diamond cutter may comprise steps of mixing CoCuFeP as a metal binder with a plurality of diamond particles as a part of a diamond table; and subjecting the diamond table to a condition of temperature and pressure suitable to produce the impregnated diamond cutter.

Optionally in any embodiment, the metal binder may comprise an abrasive material.

Optionally in any embodiment, the abrasive material may comprise tungsten carbide (WC).

Optionally in any embodiment, the plurality of diamond particles may have a size ranging from about 500 μm to about 707 μm.

Optionally in any embodiment, the tungsten carbide has a size ranging from about 6 μm to about 30 μm.

Optionally in any embodiment, the tungsten carbide with a size ranging from about 1 μm to about 6 μm.

Optionally in any embodiment, the first conditions of temperature and pressure suitable for producing the green product are less than 250° C.

Optionally in any embodiment, the second conditions of temperature and pressure is under high pressure high temperature.

BRIEF DESCRIPTION OF THE DRAWINGS

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
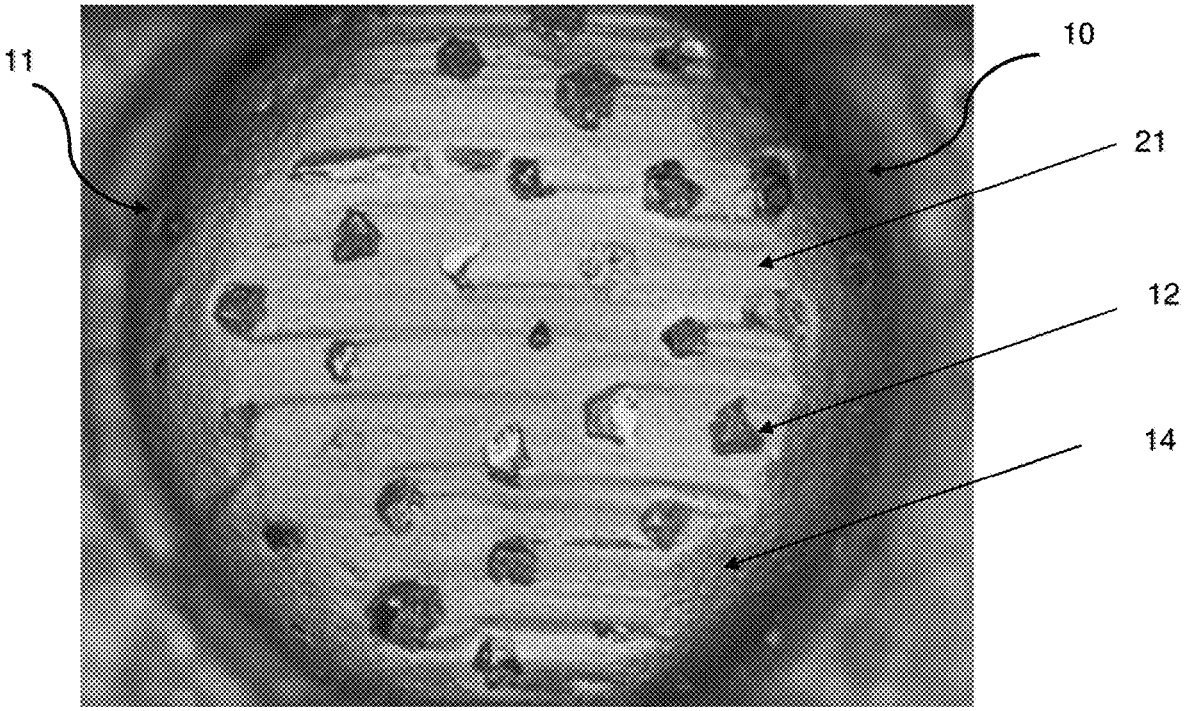
FIG. 1 is a SEM view of a cylindrical shape impregnated diamond cutter produced in a high pressure high temperature (HPHT) process according to an embodiment.

Before the description of the embodiment, terminology, methodology, systems, and materials are described; it is to be understood that this disclosure is not limited to the particular terminologies, methodologies, systems, and materials described, as these may vary. It is also to be understood that the terminology used in the description is for the purpose of describing the particular versions of embodiments only, and is not intended to limit the scope of embodiments. For example, as used herein, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

Unless otherwise indicated, all numbers expressing quantities of ingredients, properties such as size, weight, reaction conditions and so forth used in the specification and claims are to the understood as being modified in all instances by the term "about". Accordingly, unless indicated to the contrary, the numerical parameters set forth in the following specification and attached claims are approximations that may vary depending upon the desired properties sought to be obtained by the invention. At the very least, and not as an attempt to limit the application of the doctrine of equivalents to the scope of the claims, each numerical parameter should at least be construed in light of the number of reported significant digits and by applying ordinary rounding techniques.

As used herein, the term "about" means plus or minus 10% of the numerical value of the number with which it is being used. Therefore, about 50% means in the range of 45%-55%.

As used herein, the term "superabrasive particles" may refer to ultra-hard particles or superabrasive particles having a Knoop hardness of 3500 KHN or greater. The superabrasive particles may include diamond and cubic boron nitride, for example. The term "abrasive", as used herein, refers to any material used to wear away softer materials.

The term "particle" or "particles", as used herein, refers to a discrete body or bodies. A particle is also considered a crystal or a grain.

The term "impregnated diamond cutter", as used herein, refers to a sintered product made using super abrasive particles, such as diamond feed or cubic boron nitride particles. The compact may include a support, such as a tungsten carbide support, or may not include a support. The "impregnated diamond cutter" is a broad term, which may include cutting element, cutters, or polycrystalline cubic boron nitride insert.

The term "cutter", as used herein, means and includes any element of an earth-boring tool that is used to cut or otherwise disintegrate formation material when the earth-boring tool is used to form or enlarge a bore in the formation.

The term "earth-boring tool", as used herein, means and includes any tool used to remove formation material and form a bore (e.g., a wellbore) through the formation by way of removing the formation material. Earth-boring tools include, for example, rotary drill bits (e.g., fixed-compact or "drag" bits and roller cone or "rock" bits), hybrid bits including both fixed compacts and roller elements, coring bits, percussion bits, bi-center bits, reamers (including expandable reamers and fixed-wing reamers), and other so-called "hole-opening" tools.

The term "feed" or "diamond feed", as used herein, refers to any type of diamond particles, or diamond powder, used as a starting material in further synthesis of impregnated diamond cutter.

The term "superabrasive", as used herein, refers to an abrasive possessing superior hardness and abrasion resistance. Diamond and cubic boron nitride are examples of superabrasives and have Knoop indentation hardness values of over 3500.

The terms "diamond particle" or "particles" or "diamond powder", which is a plurality of a large number of single crystal or polycrystalline diamond particles, are used synonymously in the instant application and have the same meaning as "particle" defined above.

In a particular case, a polycrystalline diamond composite compact comprises a plurality of crystalline diamond grains, which are not bound to each other, but instead are bound together by foreign bonding materials such as a binder, e.g. borides, nitrides, carbides, bonded diamond material.

Impregnated diamond cutters may be fabricated in different ways and the examples discussed herein do not limit a variety of different types of diamond composites and Impregnated diamond cutters which may be produced according to an embodiment.

The invention discloses an application of diamond granules with CoCuFeP as a metal binder in fabrication of impregnated diamond cutters. The present embodiment provides a way to wet the diamond by the binder CoCuFeP in order to increase bonding between diamond particles and tungsten carbide during the HPHT synthesis. Moreover, the same idea can also improve the uniformity of diamond feeds blending, resulting in a uniform distribution of broad sized diamond grains.

An impregnated diamond cutter 10 in accordance with an embodiment is shown in FIG. 1. The impregnated diamond cutter 10 may be inserted into a downhole of a suitable tool, such as a drill bit, for example. One example of the impregnated diamond cutter 10 may include a superabrasive volume 11. The superabrasive volume 11 may comprise a top surface 21.

In one embodiment, the impregnated diamond cutter 10 may be a standalone cutter without a substrate. In another embodiment, the impregnated diamond cutter 10 may include a substrate. The superabrasive volume 11 may be formed by a plurality of diamond particles 12 and a matrix material 14. The matrix material 14 may include an abrasive material and a metal binder. The abrasive material may further include a carbide, such as tungsten carbide (WC), silicon carbide (SiC), silicon nitride, etc. The diamond particles bonded in part by the metal binder. The metal binder may include a metal alloy, such as CoCuFeP, for example.

In one embodiment, the plurality of diamond particles have a size ranging from about 500 μm to about 707 μm. In one embodiment, the tungsten carbide has a size ranging from about 6 μm to about 30 μm. In another embodiment, the tungsten carbide with a size ranging from about 1 μm to about 6 μm.

In one embodiment, the substrate 20 may be cemented cobalt tungsten carbide, while the superabrasive volume 12 may be formed from a polycrystalline ultra-hard material, such as polycrystalline diamond or diamond crystals bonded by a foreign material. In one embodiment, metal binder may comprise CoCuFeP.

Although in accordance with an embodiment, the alloy, such as CoCuFeP is used in combination with the tungsten carbide, it is possible for other alloys to be employed. The alloy selected must be capable of wetting the surface of the diamond particles. Such alloys typically have a relatively low melting temperature. When using such alloys within the powdered metal matrix, upon applying heat, the alloys prepares the surfaces of the diamond particles so that the surfaces have a greater affinity for the matrix material. Once the surfaces of the diamond particles have so prepared, upon solidifying the metal matrix securely retains the diamond particles.

The amounts of tungsten carbide and CoCuFeP alloy used in the mixture vary depending upon the particular use intended for the drill bit. Since the tungsten carbide is more abrasive and provides for a higher degree of hardness, a greater quantity of that compound is used for more abrasive rock formations. On the other hand, where the drill is to be used in softer rock formations, a greater quantity of the CoCuFeP alloy can be employed.

In general, a powdered metal matrix includes between about 15% to about 50% by weight of a metal alloy having a relatively low melting temperature and capable of properly preparing the surface of the diamond particles (in the preferred embodiment the CoCuFeP alloy), 10% to 50% tungsten carbide. The ratio between tungsten (WC) to the metal binder may be from about 30% to about 70%. In one embodiment, diamond particles may be about 25 volume percent, tungsten carbide about 52 volume percent, metal binder about 23 volume percent. Volume percentage of diamond particles, WC, and metal binder can be varied depending on the properties to be sought for. In general, the iron powder may be employed since it has good infiltration characteristics and serves to improve the soldering or fusing characteristics of the powdered metal matrix.

The impregnated diamond cutter are known for their toughness and durability, which allow them to be an effective cutter in demanding applications. Although one type of impregnated diamond cutter 10 has been described, other types of impregnated diamond cutters 10 may be utilized. For example, in one embodiment, impregnated diamond cutter 10 may have a chamfer (not shown) around an outer peripheral of the top surface 21. The chamfer may have a vertical height of about 0.5 mm or 1 mm, for example, and an angle of about 45° degrees, for example, which may provide a particularly strong and fracture resistant tool component.

Diamond distributed in a hard matrix may be progressively exposed as surface diamonds are worn and shed to maintain adequate rate of penetration. In the design of an impregnated cutter, two competing processes must be balanced. If the embedded diamonds are exposed too quickly, the life of the cutter is shortened. If the embedded diamonds are exposed too slowly, the overall rate of penetration will be reduced. An important parameter is what matrix material is used to retain the diamond.

With the impregnated diamond cutters, as the metal matrix wears away, new diamonds are exposed with such diamonds providing new cutting surfaces. Ideally, the diamonds should be evenly dispersed within the metal matrix so that as the matrix wears, there are always new diamond cutting surfaces being exposed.

In one embodiment, a method of making an impregnated diamond cutter, comprising steps of mixing CoCuFeP as a metal binder with a plurality of diamond particles as a part of a diamond table; and subjecting the diamond table to a condition of temperature and pressure suitable to produce the impregnated diamond cutter.

In another embodiment, a method of making an impregnated diamond cutter may comprise steps of mixing a metal binder with a plurality of diamond particles in liquid solution, such as isopropanol, to form a paste; extruding the paste into sausages that are rolled and dried into irregular granules; subjecting the irregular granules to a mold cavity which is under a first condition of temperature and pressure to form a green product; and subjecting the green product to a second condition of temperature and pressure suitable to produce the impregnated diamond cutter.

In general, the impregnated diamond cutters are made by placing the diamond particles within a carbon mold along with the various components of the metal matrix. In forming the impregnated diamond cutters, the diamond particles and the powder are mixed together and poured into a mold. In order to obtain better distribution of the diamonds, small quantities of the metallic powder and the diamond particles can be mixed and a plurality of such mixtures poured into the mold, a layer at a time, thereby obtaining a better distribution of the diamond particles. After the mold has been filled with the diamonds and the metallic powder so as to form the metal matrix, heat and pressure are applied.

In this embodiment, tungsten carbide (WC) particles of varying sizes are used in conjunction with CoCuFeP for the binder. Diamonds are mixed with matrix powder, binder, and liquid, such as propanol, into a paste, which is then loaded into a doser. The paste is extruded into short cylinders that are rolled and dried into irregular granules. The granules are packed into the desired areas of a mold, where they are subjected to a pre-compaction step using a cold press stage prior to hot pressing under an inert atmosphere.

As shown in Tables 1 and 2, the initial batch consisted of a 25/35 diamond mesh, most with a size distribution of ±5%. The distribution was varied to have a wider diamond size distribution in some formulas. The range of particulates is no larger than 707 μm and no smaller than 500 μm. The diamond volume percentage is varied between about 17.5% to about 27.5%. It is reported as diamond concentration, a 4× multiple of the volume percentage. The diamond granules are consistently distributed to allow a high concentration where the diamonds are not in close proximity. The diamond particle retention is increased as all portions of the diamond are encapsulated by the matrix, which in turn will increase the life of the cutter.

Selection of the matrix material must ensure processing temperatures that will not graphitize or oxidize the diamond. The matrix material must be adequately abrasion resistant so sharp diamonds are not released, impacting cutter life. Further, it must be hard to avoid localized yielding as diamonds push into the formation under high force. Tungsten carbide with a CoCuFeP binder meets these criteria. The size of the tungsten carbide particles range from fine (1-6 μm) to coarse (30-150 μm), and can be fused or spherically cast. Coarser grains are easier to infiltrate with a molten binder during the powder metallurgy processes, whereas fine grains have a higher packing density. Finer grains will have higher hardness, whereas coarser grains will have higher toughness.

TABLE 1

The design of experiment for Batch I diamond containing impregnated cutters.

| Sample ID | Diamond Size (mesh) | Diamond Concentr. | WC Size | WC Type | Metal Binder | Note |
|---|---|---|---|---|---|---|
| S1 | 25/35 (+5%, −5%) | 70 | 1-6 μm | WC | CoCuFeP | |
| S2 | 25/35 (+5%, −5%) | 100 | 1-6 μm | WC | CoCuFeP | Higher Diamond Concentr. |
| S3 | 25/35 (+5%, −5%) | 70 | 6-30 μm | WC | CoCuFeP | Coarser WC, compared with |
| S4 | 25/35 (+5%, −5%) | 100 | 6-30 μm | WC | CoCuFeP | S1 and S2 |
| S5 | 25/35 (+10%, −15%) | 100 | 1-6 μm | WC | CoCuFeP | Wider diamond size distribution |
| S6 | 25/35 (+5%, −5%) | 70 | 1-6 μm, 6-30 μm | WC(fine), spherical cast(medium) | CoCuFeP | Mixture of WC types |
| S7 | 25/35 (proprietary aggregate) | 70 | 1-6 μm, 30-150 μm | WC(fine), fused cast WC | CoCuFeP | Another Mixture of WC types |
| S8 | 25/35 (70%) +30/40 (30%) | 110 | 1-6 μm | WC | CoCuFeP | Smaller diamond size even with higher concentr. |
| Ref. | A reference impregnated insert material | | | | | |

TABLE 2

The design of experiment for Batch II diamond containing impregnated cutters. The second DOE was created in order to optimize S5 and evaluate the novelty of the invention.

| Sample ID | Diamond Size (mesh) | Diamond Concentr. | WC Size | WC Type | Metal Binder | Note |
|---|---|---|---|---|---|---|
| S10 | 25/35 (+10, −15%) | 100 | 6-30 μm | WC | CoCuFeP | |
| S11 | 25/35 (+10, −15%) | 100 | 1-6 μm | WC | CoCuFeP | Coarse center diamond |
| S12 | 25/35 (+10, −15%) | 100 | 1-6 μm | WC | CoCuFeP | Fuse cast carbides |
| S13 | 25/35 (+10, −15%) | 100 | 6-30 μm | WC | CoCuFeP | Fuse cast carbides |
| S14 | 25/35 (+5, −5%) | 100 | 1-6 μm | WC | CoCuFeP | Coarse center diamond, fuse cast carbide |
| S15 | 25/35 (+30, −40%) | 100 | 1-6 μm | WC | CoCuFeP | Coarse center diamond |
| S16 | 25/35 (+10, −15%) | 100 | 6-30 μm + 30-150 μm | WC | CoCuFeP | |
| S17 | 25/35 (+30, −40%) | 110 | 1-6 μm | WC | CoCuFeP | |
| S5 | 25/35 (+10, −15%) | 100 | 1-6 μm | WC | CoCuFeP | S5 from Batch I |
| Ref. | Baseline reference material | | | | | |

A blending process is performed separate diamond grits from each other to avoid diamond clustering, which is considered the weak paint of the impregnated inserts for premature failure during drilling process.

Diamond granules are formed by mixing diamonds with matrix powder, a binder with liquid, such as isopropanol, into a paste. Coated diamond particles are surrounded by matrix powder and loaded into a doser. The paste is then extruded through a granulator into short "sausages" that are rolled and dried into irregular granules. The granules are meshed to the desired size and distribution.

The process for making diamond-impregnated matrix for bit bodies involves hand mixing of matrix powder with diamonds and a binder to make a paste. The doser weighs out the amount that will go into the mold. The paste is then packed into the desired areas of a mold. The pellets are transferred into a mold cavity, where they are subjected to a pre-compaction step under a cold press stage.

Palletizations allow an even distribution of diamond, protecting them during the heating cycles, and improves bonding. Well distributed diamonds result in a higher efficiency and longer lasting bit. Diamond clustering will lead to more diamonds being shed with an equal amount of matrix wear as a smaller area of matrix is holding more diamonds. Therefore, the cutter life will be shorter as diamonds are shed before they are blunt, and fresh diamonds are prematurely exposed.

Impregnated bits are typically formed into a solid body of matrix material formed by a number of powder metallurgy processes. Abrasive particles and a matrix powder are infiltrated with a molten binder material. Upon cooling, the bit body includes the binder and matrix material as well as the diamond particles suspended near and on the surface of the drill bit. The diamond can be either natural or synthetic diamond. Typically, the synthetic diamond used is a single crystal. Thermally stable polycrystalline diamond may also be used.

Figure 2:
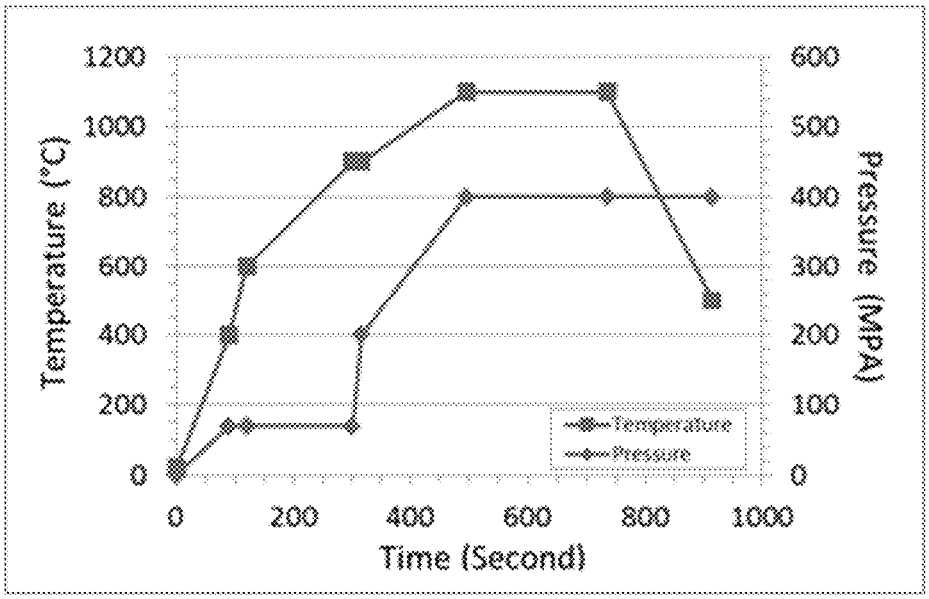
FIG. 2 illustrates the pressure/temperature vs. time of the hot pressing according to one embodiment.

FIG. 2 has shown dramatical drop in stability for diamond process above 850° C.-1100° C. Hot pressing (high pressure and high temperature) should be done in an inert atmosphere to avoid oxidation of the cutter material. Again, the relatively low processing temperature and time should be selected to avoid damaging the diamond and thus cutting performance.

Figure 3:
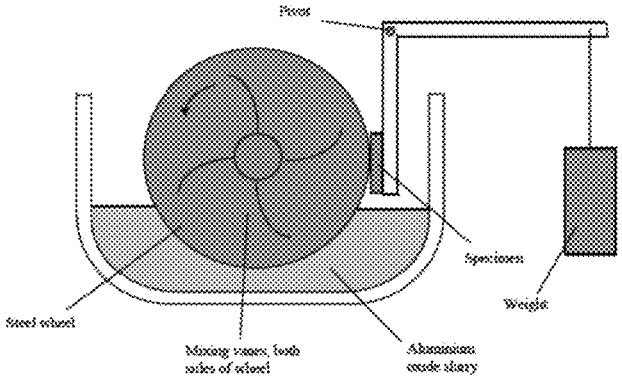
FIG. 3 depicts the ASTM B611 schematic wear test and test parameters according to one embodiment.

As shown in FIG. 3, ASTM B611 testing was performed on 25×75×6 mm coupons in triplicate in order to ascertain the wear resistance. ASTM B611 covers the determination of abrasive wear resistance of cemented carbides under high stress abrasive conditions. It is a practical test for comparing the formulas in standardized conditions. A vessel contains abrasive slurry that a wheel rotates in contact with the specimen. The slurry consists of 30 mesh grit in proportion of 4 g to 1 $cm^3$ of water.

Figure 4:
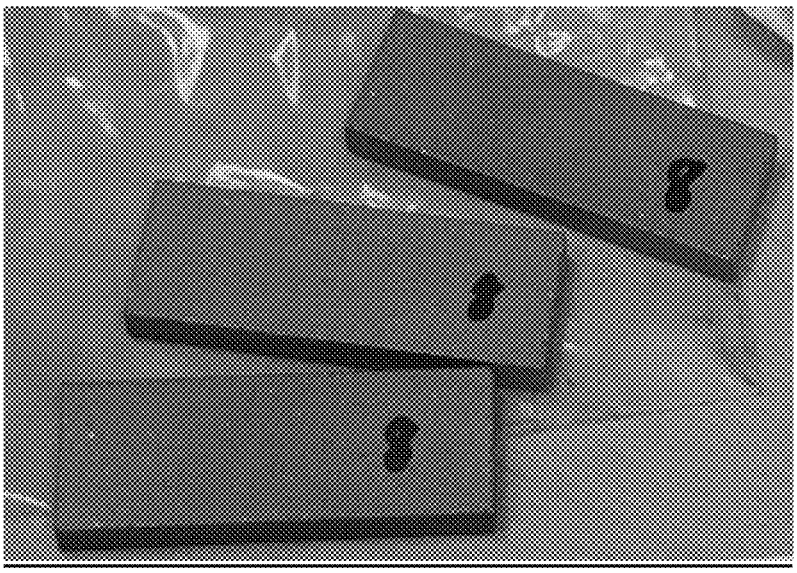
FIG. 4 shows the samples for ASTM B611 wear tests according to one embodiment.
Figure 5:
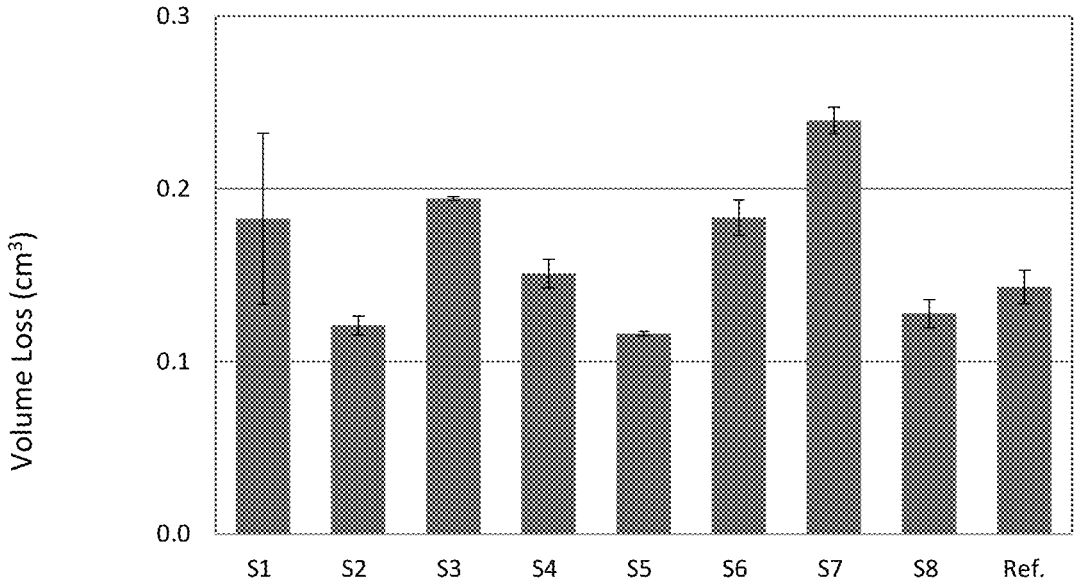
FIG. 5 shows the volume loss in the Batch I including samples S1-S8 and Reference.

In one embodiment, the impregnated diamond cutter can be made in a cylindrical forms (shown in FIG. 1) for drill bits. In another embodiment, the impregnated diamond cutter (sample S8) may be made in a rectangular forms for ASTM B611 wear test as shown in FIG. 4. After testing, a wear scar forms where the abrasive slurry was able to erode the matrix, causing diamonds to shed. The subsequent volume loss may be measured to rank performance relative to a commercial reference. The test provides an estimate of field performance, so the sample with the least amount volume loss should have the highest field performance.

Figure 6:
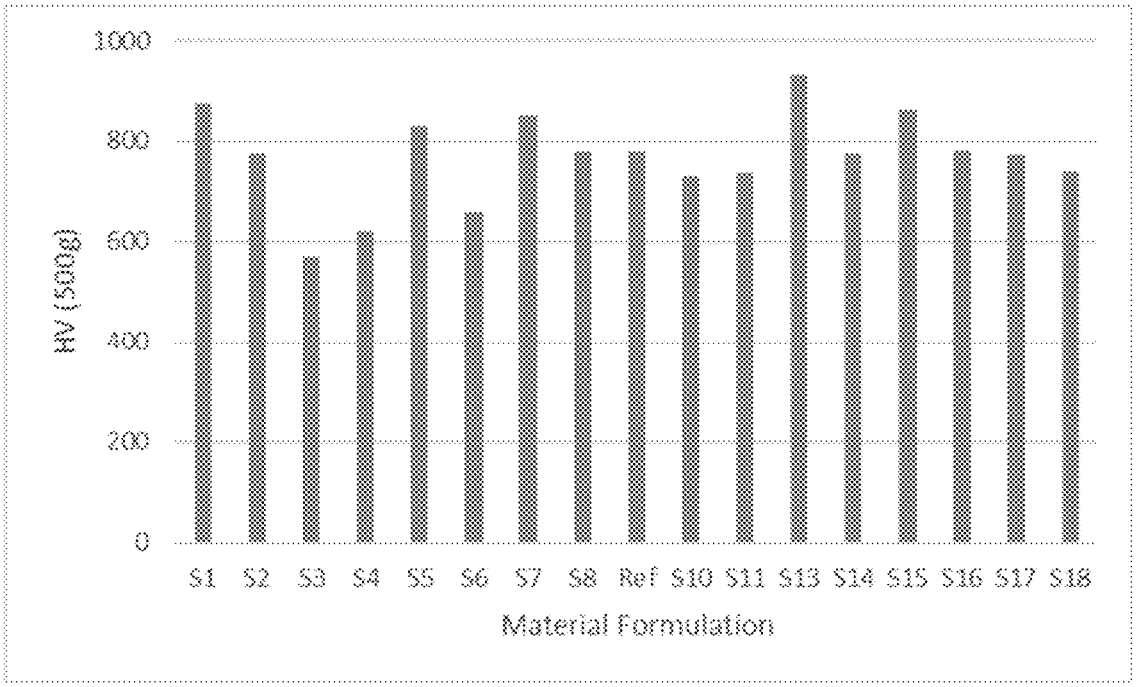
FIG. 6 is chart showing matrix hardness of samples S1-S18 with Reference sample measured by Vickers microhardness.

The average and standard deviation for samples S1-S8 and reference are presented in FIG. 6. Three samples (S2, S5, and S8) had a smaller volume loss than the reference sample. All of these formulas had fine grain tungsten carbide. Further, all of these had a diamond concentration of 100 or more. The sample, S1, with fine grains but a diamond concentration of 70 had a higher volume loss, indicating that a higher diamond concentration with all other parameters the same (S2) will result in better volume retention. A wider diamond distribution (S5) over a tight distribution (S2) may be beneficial up to a very wide distribution (S8). A very high concentration with a wide distribution (S8) has a diminished performance to a high concentration with a moderate distribution (S5).

The matrix hardness measured by Vickers microhardness is presented in FIG. 6. S1, S2, S5, S7, S8, S13, and S15 all had higher matrix hardness than the reference material. S2 and S8 were very close to the reference. All of the tungsten carbide matrixes with similar or higher hardness were fine grain except S13. S13 had tungsten carbide with sizes from about 6 μm to about 30 μm, but tungsten carbide used as fuse cast carbides. Additionally, S7 did use a combination of mostly fine and some coarse grains. The harder fine grains increase the wear resistance and thus performance of the cutter.

Figure 7:
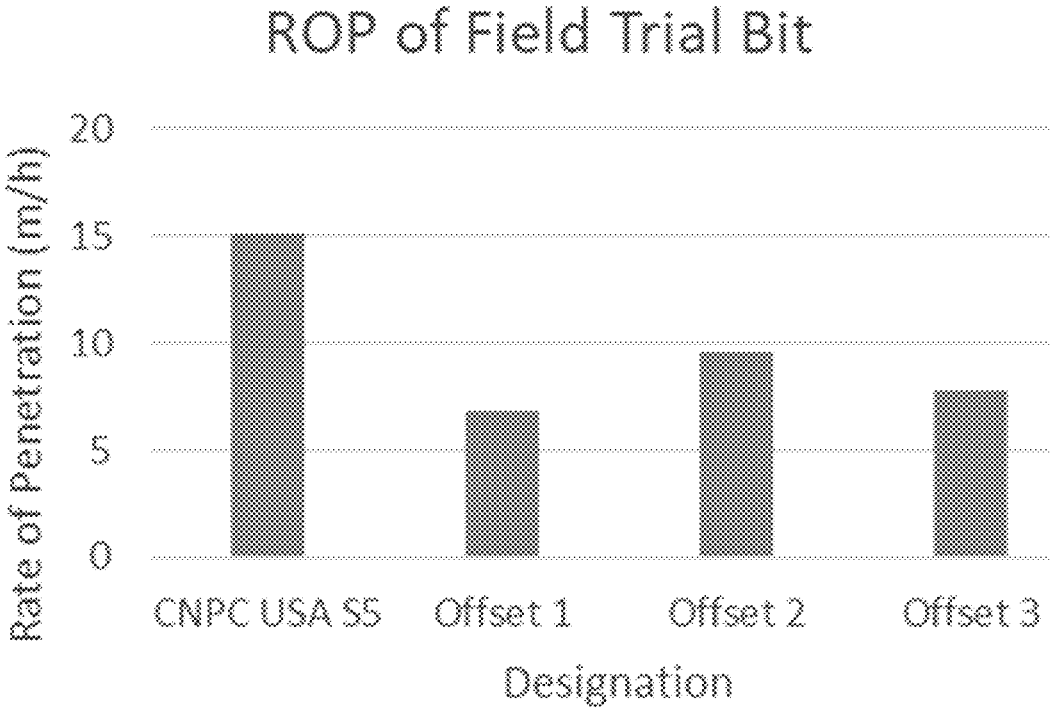
FIG. 7 illustrates the average ROP of sample S5 compared to adjacent platforms using commercial bits.

FIG. 7 illustrates the average ROP of sample S5 compared to adjacent platforms using commercial bits. Sample S5 shows that its rate of penetration is about 15 m/h. The rates of penetration (ROP) for other references or commercial bits could not even achieve 10 m/hour. The use of the S5 cutters significantly improved average ROP compared to the commercial bits used on the adjacent platforms. Results from the field trial indicated that the impregnated bits needed improved wear resistance, particularly as a function of rate of penetration. A focus on using coarse center diamonds with distribution of smaller diamonds to protect the larger diamonds was theorized to increase wear resistance.

Figure 8A:
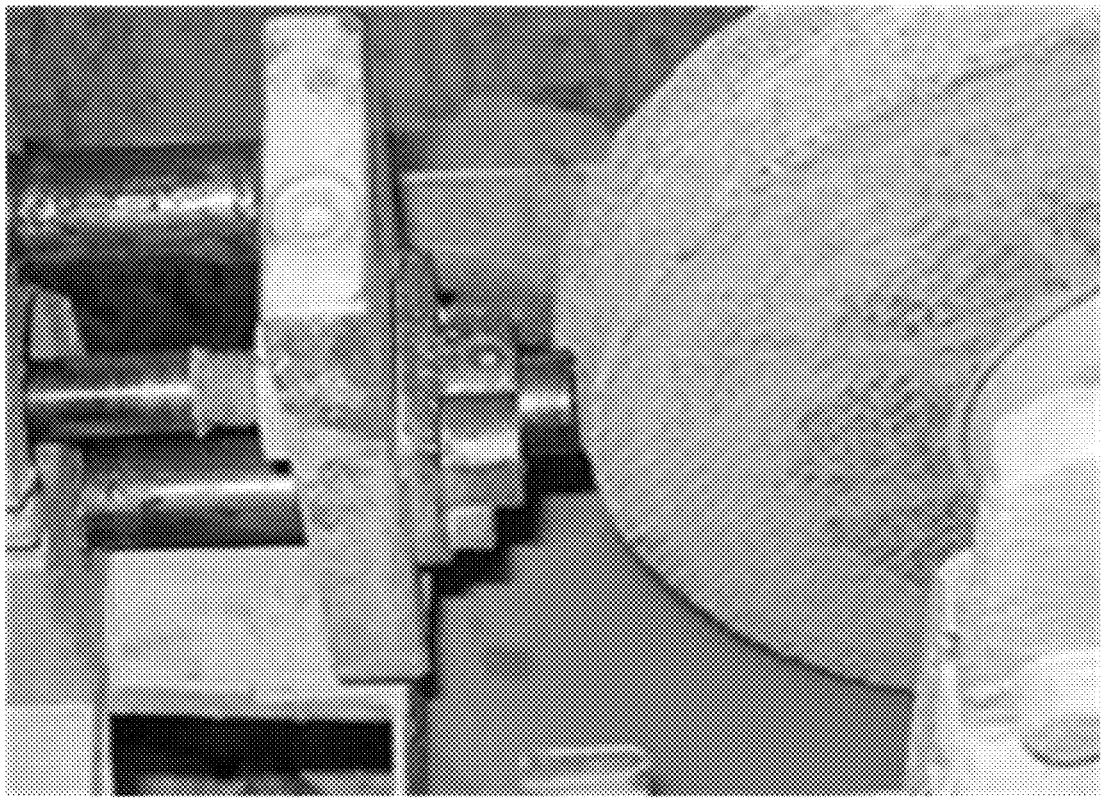
FIG. 8A illustrates an image of the modified ASTM B611 testing apparatus.
Figure 8B:
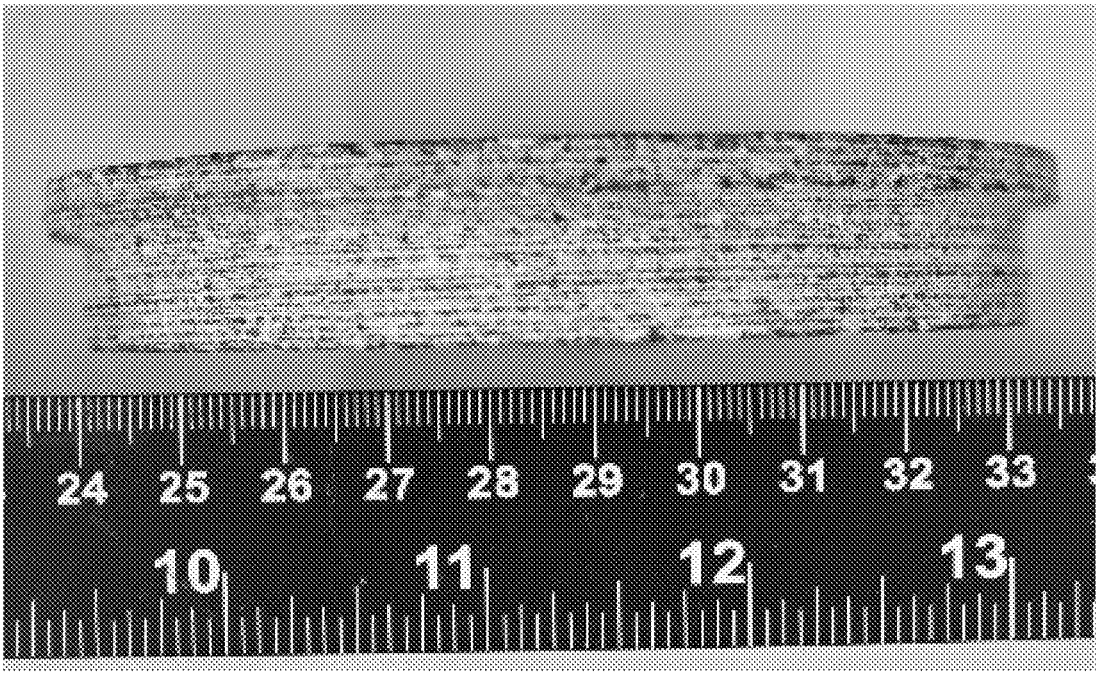
FIG. 8B illustrates a track ground into the disc after testing.

FIG. 8A shows Modified ASTM B611 test using a Ø13.5×18 mm cylinder. FIG. 8B illustrates granite disc after removing 20 mm. Testing will be more representative of field conditions as the cutter sample is actually removing material from a hard workpiece. Testing is more similar to field conditions in how the matrix/metal bond. An insignificant height reduction will occur as the inserts are too wear resistant. A better metric, the cutting efficiency, may be calculated by taking the granite disc mass loss divided by the time. The highest ROP will indicate the best formula for field trials.

Figure 9:
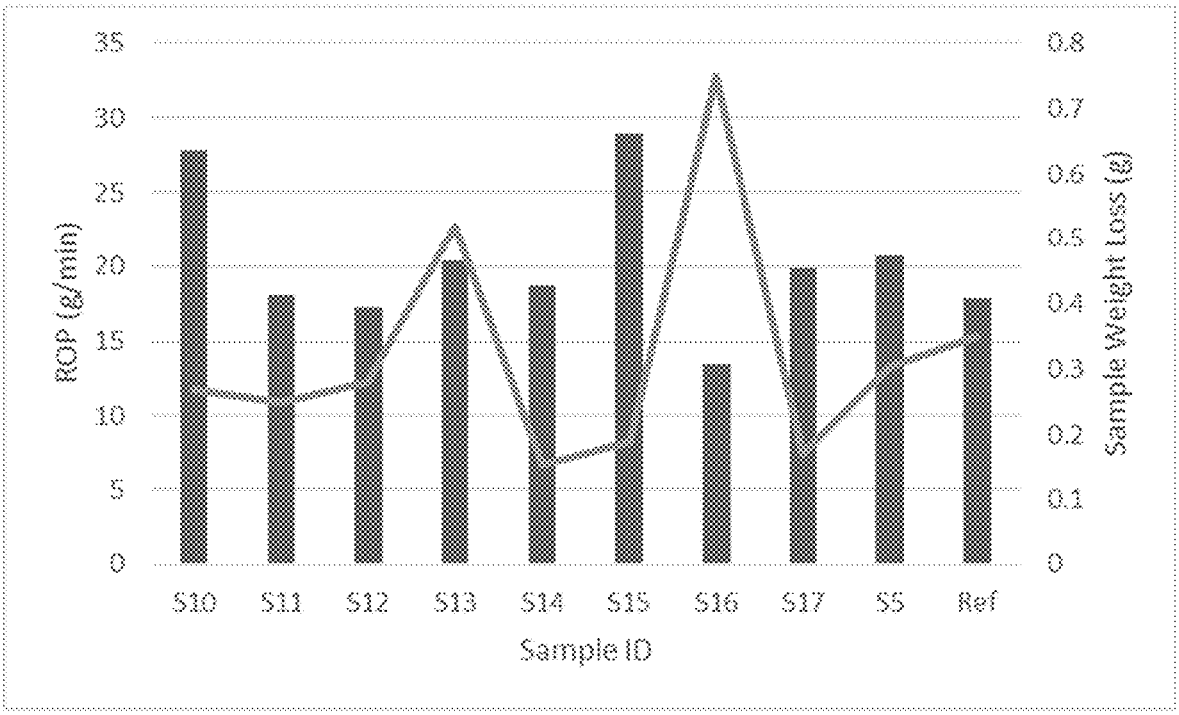
FIG. 9 compares the ROP with the sample weight loss for the corresponding sample.

As shown in FIG. 9, the ROP is shown as a bar graph with the sample weight loss shown as a curve line for the corresponding sample. Sample S5 outperformed the reference sample, but by a slightly smaller margin (19 vs 15%). Samples S10 and S15 with low weight loss outperformed both the reference and S5 by significant amounts, implying either would have excellent field service.

Figure 10:
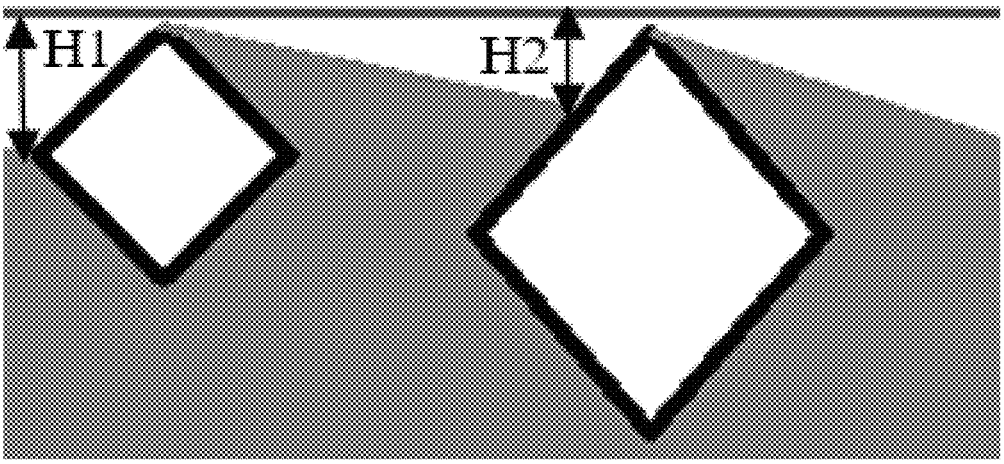
FIG. 10 illustrates an explanatory mechanism for coarse center diamonds being protected by smaller diamonds.

FIG. 10 illustrates an explanatory mechanism for coarse center diamonds being protected by smaller diamonds. The overall protrusion height of the coarse center diamond is reduced as the finer diamond will protect the matrix retaining the larger diamond, allowing for longer use of a diamond before it is shed. The superior performance of S15 with a coarser diamond and a larger distribution of sizes may be explained by this FIG. 10.

Figure 11:
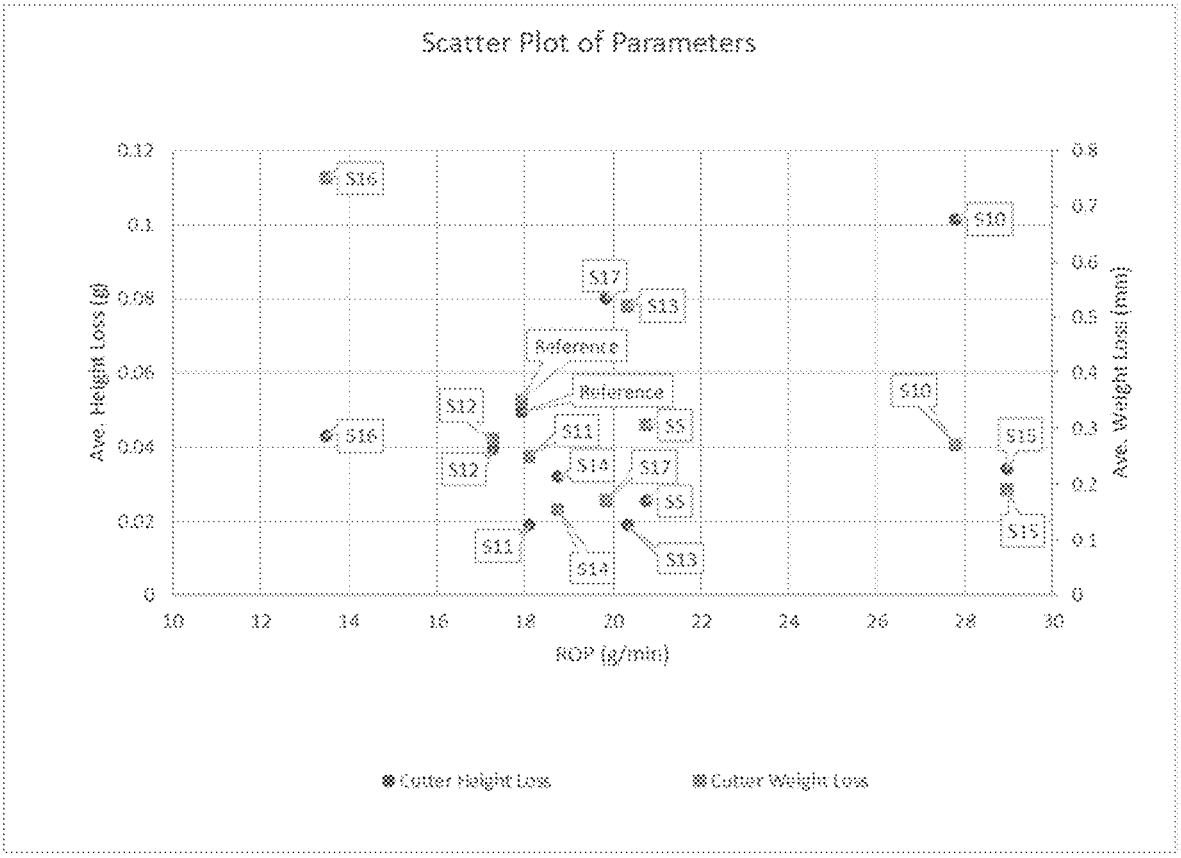
FIG. 11 illustrates a possible correlation between the weight loss and height loss with ROP. S15 demonstrates to have a unique performance.
Figure 12A:
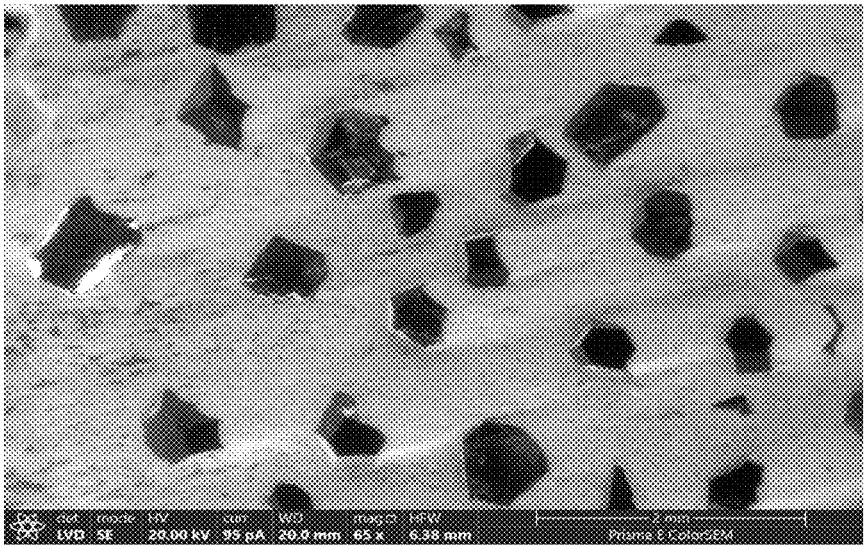
FIG. 12A illustrate finer diamonds exposed and protecting coarser diamonds, resulting in a higher ROP for sample S10 at 65*x*.
Figure 12B:
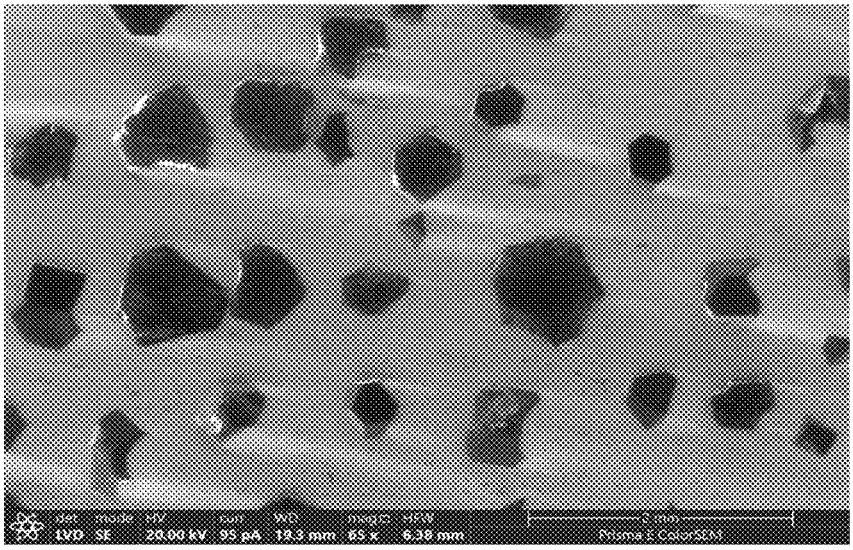
FIG. 12B demonstrates that large adjacent diamonds do not enhance performance for sample S11 at 65*x*.
Figure 12C:
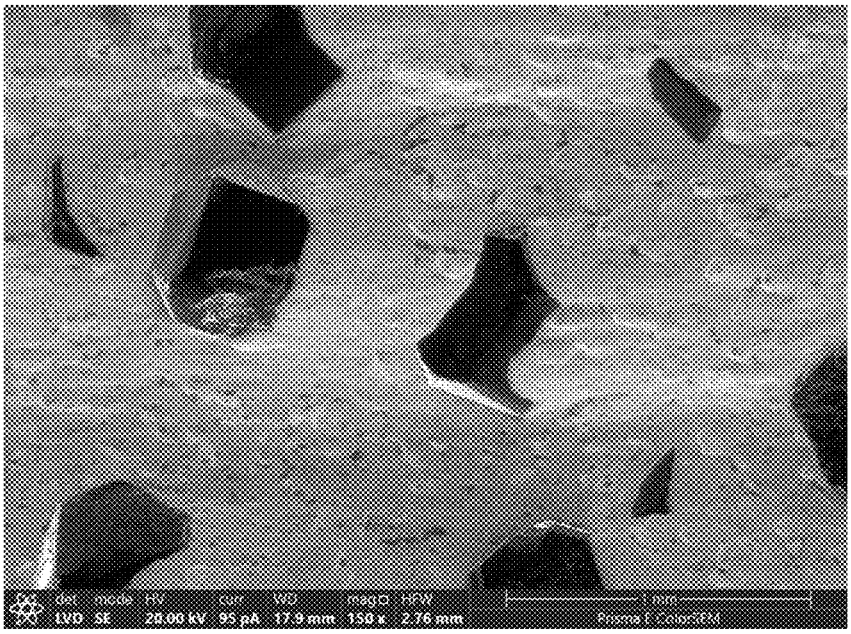
FIG. 12C shows some finer diamonds protecting the coarser diamonds, but with a medium grain WC for sample S13 at 150*x*.
Figure 12D:
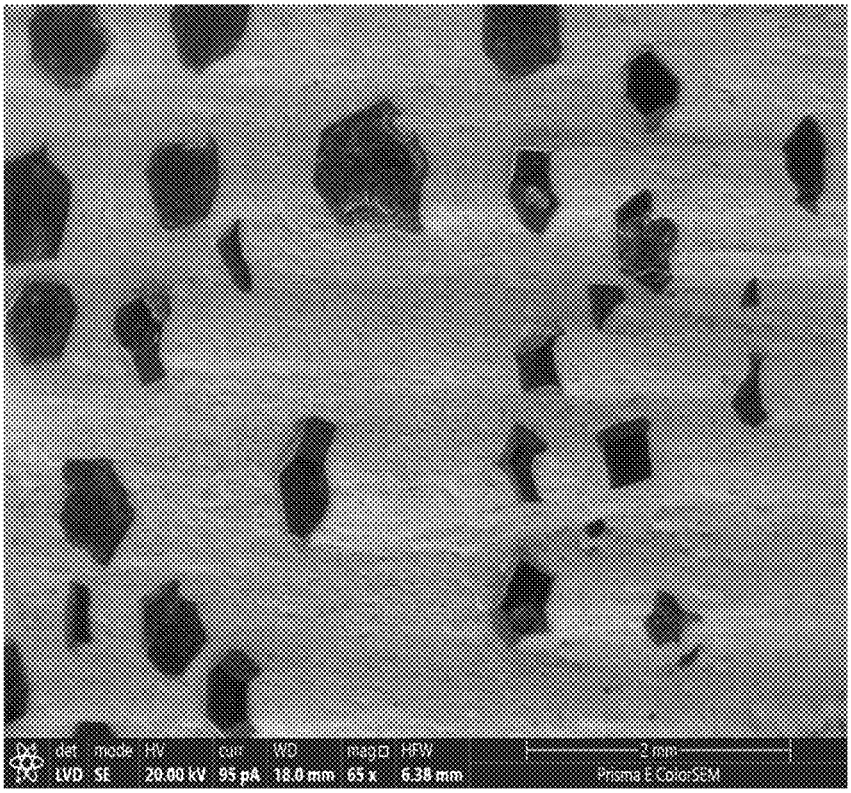
FIG. 12D shows coarse center diamond and fused cast carbide for sample S14 at 65*x*.
Figure 12E:
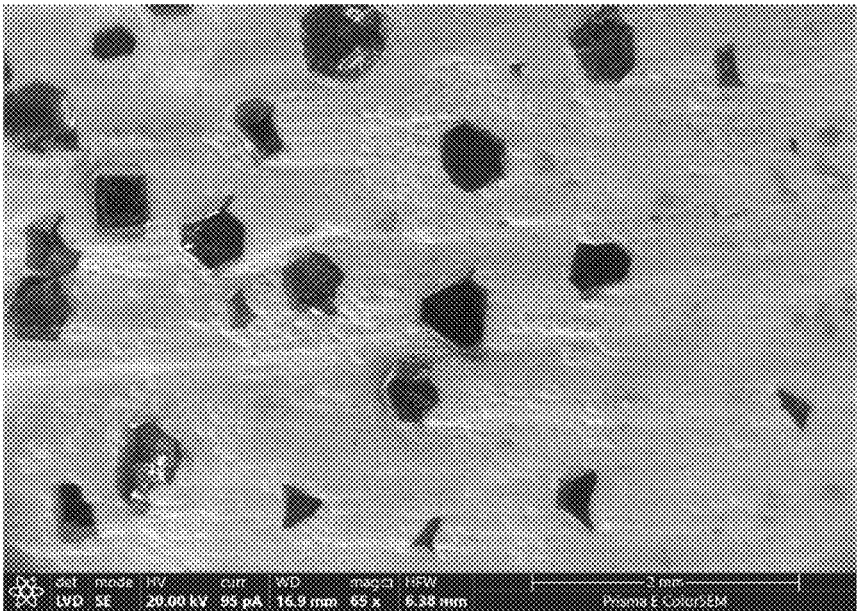
FIG. 12E shows a wide distribution of diamond size for a coarse center diamond for sample S15 at 65*x*. The wear scars are well distributed, showing this iteration had unexpected excellent performance.
Figure 12F:
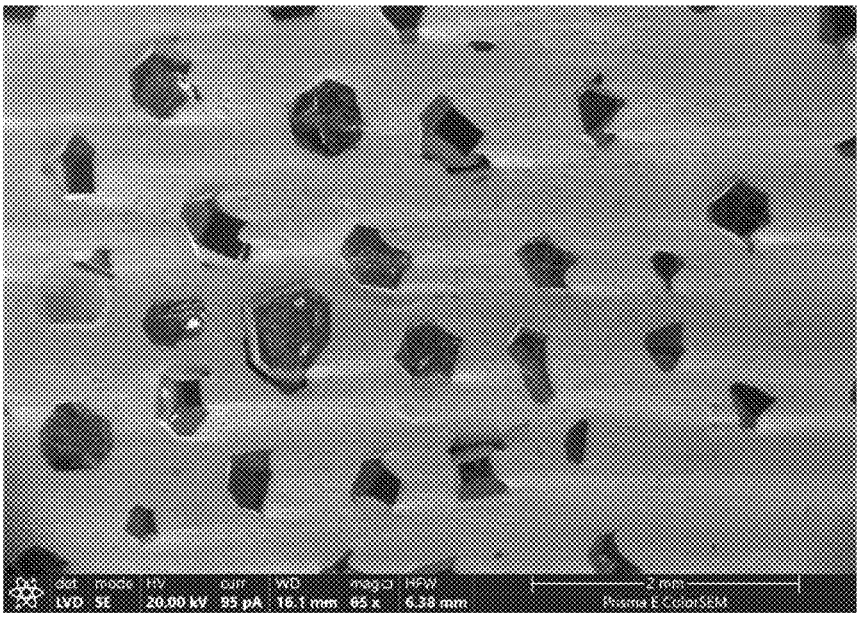
FIG. 12F demonstrates diamond pullout, making an argument against large grains for sample S16 at 65*x*.
Figure 12G:
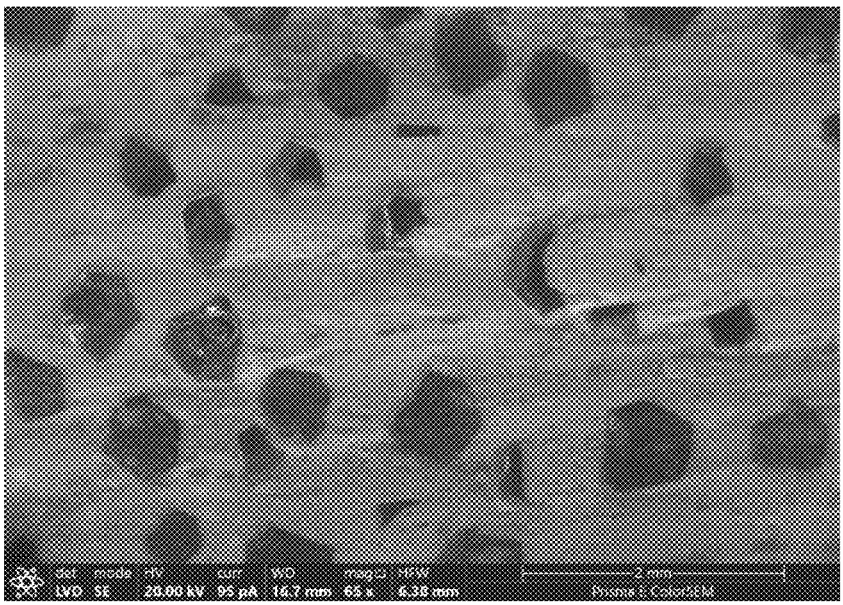
FIG. 12G shows that performance being too high of a concentration may be deleterious to ROP for sample S17 at 65*x*.
Figure 12H:
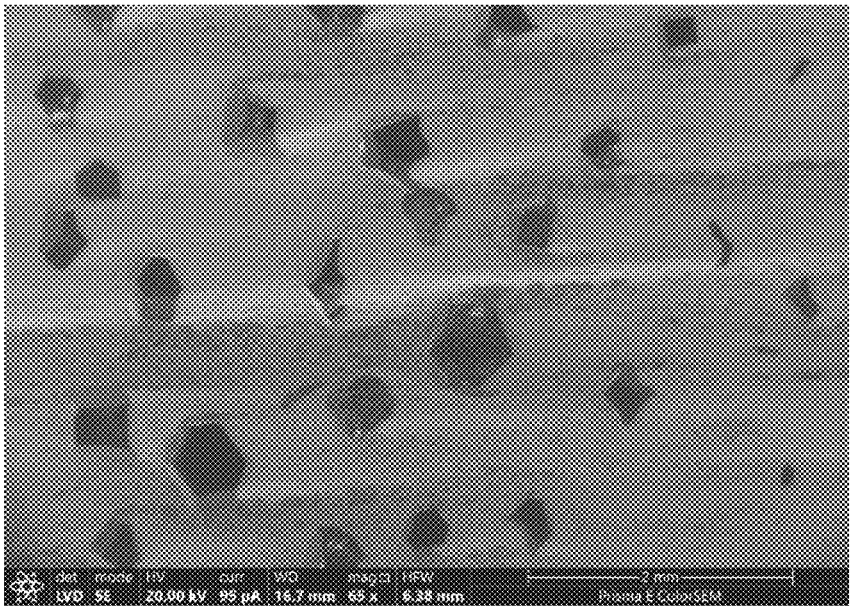
FIG. 12H shows SEM images of the wear face after testing for sample S5 from Batch 1.
Figure 12I:
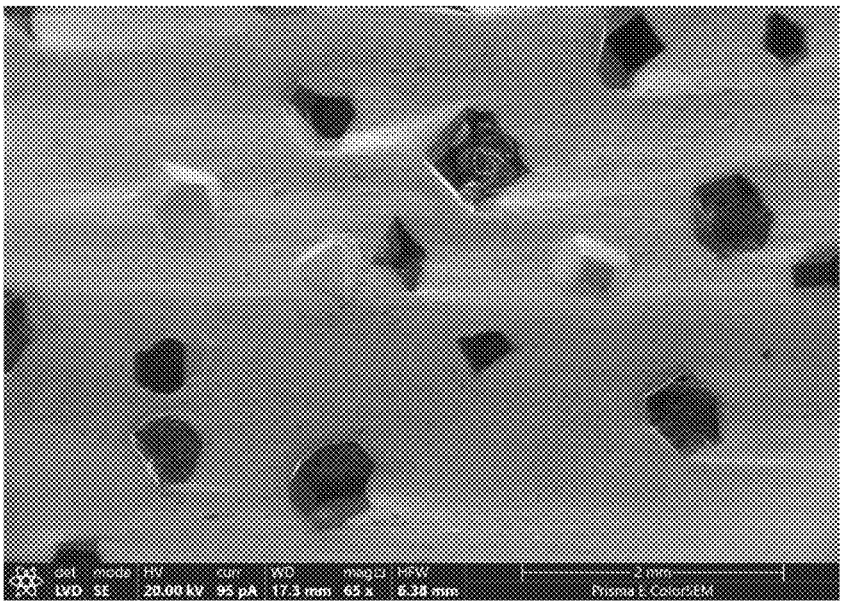
FIG. 12I shows SEM images of the wear face after testing for sample reference.

FIG. 11 shows ROP as an X-axis; and average height loss and average weight loss as a first Y-axis and a second Y-axis, respectively. Square refers to ROP-Weight loss while dot denotes height loss. S10 shows high an ROP and low weight loss, but relatively high height loss. This is a generally expected trend. Most other formulations are clustered from 17-21 g/min, showing the unexpected performance of S15. An optimal performance would be a sample with zero height and mass loss with a high ROP that would be plotted in the bottom right of the figure. S15 exhibits these properties with a good result, wherein S15 has a close to 29 g/min of ROP with low weight loss (close to 0.19 g) and low height loss (0.034 mm), as shown in below Table 3.

TABLE 3

| Sample ID | Avg Weight Loss (g) | Avg Height Loss (mm) | ROP (g/min) |
|---|---|---|---|
| S10 | 0.27 | 0.1015 | 27.8 |
| S11 | 0.25 | 0.019 | 18.1 |
| S12 | 0.28 | 0.0395 | 17.3 |
| S13 | 0.52 | 0.019 | 20.3 |
| S14 | 0.155 | 0.032 | 18.8 |
| S15 | 0.19 | 0.034 | 29 |
| S16 | 0.75 | 0.043 | 13.5 |
| S17 | 0.17 | 0.08 | 19.9 |
| S5 | 0.305 | 0.0255 | 20.8 |
| Ref | 0.35 | 0.0495 | 17.9 |

FIG. 14A-141 show SEM images of the wear face after testing for various samples. The various images demonstrate the claims of smaller diamonds protect larger protruding diamonds.

While reference has been made to specific embodiments, it is apparent that other embodiments and variations can be devised by others skilled in the art without departing from their spirit and scope. The appended claims are intended to be construed to include all such embodiments and equivalent variations.

We claim:

1. A method of making an impregnated diamond cutter, comprising:

mixing a metal binder with a plurality of diamond particles to form a paste;

extruding the paste into sausages that are rolled and dried into irregular granules;

subjecting the irregular granules to a mold cavity which is under a first condition of temperature and pressure to form a green product;

subjecting the green product to a second condition of temperature and pressure suitable to produce the impregnated diamond cutter; and wetting the plurality of diamond particles with the metal binder to increase bonding between diamond particles.

2. The method of claim 1, wherein the plurality of diamond particles have a size ranging from about 500 μm to about 707 μm.

3. The method of claim 1, wherein the plurality of diamond particles have diamond volume percentage between about 17.5% to about 27.5%.

4. The method of claim 1, wherein the metal binder comprises CoCuFeP.

5. The method of claim 1, wherein the metal binder comprises an abrasive material.

6. The method of claim 5, wherein the abrasive material comprises tungsten carbide (WC).

7. The method of claim 1, wherein the first conditions of temperature suitable for producing the green product are less than 250° C.

8. The method of claim 1, wherein the second conditions of temperature and pressure is under higher pressure and higher temperature than the first conditions of temperature and pressure.

9. A method of making an impregnated diamond cutter, comprising:

mixing CoCuFeP as a metal binder with a plurality of diamond particles as a part of a diamond table;

subjecting the diamond table under a first condition of temperature, wherein the temperature is under 250° C.;

subjecting the diamond table to a second condition of temperature and pressure suitable to produce the impregnated diamond cutter; and wetting the plurality of diamond particles with CoCuFeP to increase bonding between diamond particles.

10. The method of claim 9, wherein the plurality of diamond particles comprise a plurality of polycrystalline diamond particles with a size ranging from about 500 μm to about 707 μm.

11. The method of claim 9, wherein the diamond table further comprises an abrasive material.

12. The method of claim 11, wherein the abrasive material comprises tungsten carbide (WC).

13. The method of the claim 12, wherein the tungsten carbide has a particle size of from about 6 μm to about 30 μm.

* * * * *